United States Patent [19]

Scott

[11] Patent Number: 4,960,267

[45] Date of Patent: Oct. 2, 1990

[54] EDGE-REINFORCED SPRING BEDDING PRODUCT

[75] Inventor: Terence A. Scott, Carthage, Mo.

[73] Assignee: Leggett & Platt, Incorporated, Carthage, Mo.

[21] Appl. No.: 357,534

[22] Filed: May 26, 1989

[51] Int. Cl.[5] ..... A47C 27/04

[52] U.S. Cl. ..... 267/91; 5/248; 5/474; 5/475

[58] Field of Search ..... 5/475, 474, 248, 246, 5/256; 267/91, 103

[56] References Cited

U.S. PATENT DOCUMENTS

| | | | |
|---|---|---|---|
| 3,590,404 | 7/1971 | Dreve, Jr. | 5/474 |
| 4,051,567 | 10/1977 | Hutchinson | 5/260 |
| 4,867,423 | 9/1989 | Marsh | 267/91 |
| 4,905,333 | 3/1990 | Scott | 5/248 |

FOREIGN PATENT DOCUMENTS

| | | | |
|---|---|---|---|
| 1209728 | 8/1986 | Canada . | |
| 2705956 | 12/1977 | Fed. Rep. of Germany | 267/91 |
| 1104884 | 3/1968 | United Kingdom . | |
| 2143731 | 11/1986 | United Kingdom . | |

*Primary Examiner*—Alexander Grosz

*Attorney, Agent, or Firm*—Wood, Herron & Evans

[57] ABSTRACT

A spring interior comprising a plurality of longitudinally extending bands of springs disposed side by side and connected together by helical lacing wires in the top and bottom faces of the bands. Each band of springs comprises a single length of wire formed into a plurality of substantially vertical coil springs interconnected by interconnecting segments of wire located alternately in the top and bottom faces of the bands. The endmost coil springs of each row are interlaced for the length of the coil with the next adjacent coil of the same row such that the axes of the last two coils in each row are substantially coaxial.

3 Claims, 3 Drawing Sheets

EDGE-REINFORCED SPRING BEDDING PRODUCT

This invention relates to spring interiors, and specifically to spring interiors for bedding products, such as mattresses and the like.

A known form of spring interior comprises a plurality of longitudinally extending bands of springs disposed side by side and connected together by helical wires which extend transversely of the bands and embrace portions of the bands. Several kinds of bands of springs have been proposed for incorporation in spring interiors. One kind of band, which is the subject of British Pat. No. 1,104,884, will hereinafter be referred to as a band of interlocked or interlaced springs. It comprises a single length of spring wire shaped to form a plurality of individual coil springs arranged in a row, one end turn of each coil spring lying adjacent to a top face of the band and the other end turn of each coil spring lying adjacent to a bottom face of the band, each coil spring being of a rotational hand opposite to the rotational hand of the adjacent coils immediately before and after it in the row, and being joined to the adjacent coil springs by a pair of interconnecting segments of wire integral with the coil springs. One of the pair of interconnecting segments is located in the bottom face of the band, and the other of the pair of interconnecting segments is located in the top face of the band. Each interconnecting segment comprises a bridging portion between adjacent coils, which bridging portion extends lengthwise of the row.

When bands of interlocked springs of the type described hereinabove are assembled to form a spring interior, they are disposed side by side and interconnected by helical wires, some of which lie in the top face of the spring interior and others of which lie in the bottom face thereof, the top and bottom faces of the spring interior being the faces defined by the top and bottom faces of the bands incorporated in the spring interior. Each helical wire extends across the bands of springs and embraces portions of wires of the bands that extend transversely of the bands from the ends of the bridging portions of the links. In the top face of the spring interior the helical wires are disposed at uniform intervals along the bands of springs, the arrangement being such that there are two springs disposed in the interval between each helical wire and the next. There is a similar arrangement in the bottom face of the spring interior.

It will be appreciated from the foregoing description that the top face of a spring interior assembled in this way has the general appearance of a rectangular grid. Each of the transverse elements of the grid comprises a helical wire, and each of the longitudinal elements of the grid comprises a row of mutually aligned bridging portions. Within the confines of each rectangle of the grid and disposed a little lower than the grid are the upper end portions of two adjacent coil springs, those two springs constituting parts of the same band of springs. The bottom face of the spring interior is, of course, similar to the top face, though inverted.

In this description of the invention there are references to faces of bands of springs and of spring interiors. As the bands of springs and spring interiors are, of course, of open-work or skeletal form, the term "face" must be understood as referring to an imaginary surface defined by the relevant parts of the bands or spring interiors. Furthermore, as the wires and helical wires are of finite width or thickness and as they sometimes overlap each other, the term "face" cannot be understood as having a strictly geometrical meaning. Nevertheless, as the faces concerned are relatively extensive and are of flat shape, their locations can in practice be determined without difficulty or ambiguity.

It is customary for a spring interior of the type described hereinabove to be incorporated in an upholstered article In such an article at least one of the main faces of the spring interior (that is the top and bottom faces thereof) is covered by a layer or layers of padding. This is turn is covered by a cover made of sheet material, such as ticking or upholstery fabric.

It is also customary for a bedding spring interior of the type described hereinabove to be surrounded by two rectangular border wires, one border wire residing in each of the top and bottom faces of the spring interior These border wires are secured to the edgemost coils of the spring interior and define the rectangular edge of the spring interior in the top and bottom faces of the spring interior.

An inherent characteristic of a spring interior of the type described hereinabove is that the axes of the coil springs, when viewed in a direction parallel to the direction of the row, and when viewed from the sides of the row, are generally perpendicular but are all slightly angled to the top and bottom faces. In part, because of this slight angulation, the top and bottom border wires do not generally overlie one another at the ends of the spring interior. As a result, it is difficult to upholster a prior art bedding spring interior of the type described hereinabove and to achieve an aesthetically pleasing appearance in the resulting product.

Another characteristic of the bedding spring interior of the prior art British patent identified hereinabove is the lack of vertical rigidity or firmness of the edge of the spring interior. Oftentimes, people sit on the edge of a bedding mattress and there is an inadequate firmness of the border to support their weight. To increase this edge firmness, it has been proposed in Canadian Pat. No. 1,209,728 to add to the spring interior an extra band or row of coils of springs at each edge of the spring interior. This doubles the number of coils along the edge of the spring interior with a resulting increase in edge firmness, but has the disadvantage of requiring a great deal of special handling to manually insert and assemble an extra row or band of coil springs along each edge of the spring interior.

It has therefore been one objective of this invention to provide an interlaced spring interior in which the top and bottom border wires overlie one another on both ends of the spring interior.

Still another objective of this invention has been to provide an interlaced spring interior in which the interior may be more easily upholstered than prior art interlaced spring interiors and in which the resulting upholstered product is more aesthetically pleasing.

Still another objective of this invention has been to provide a spring interior of the type described hereinabove which has improved edge firmness along the ends of the spring interior and in which such firmness is achieved without the need to manually handle additional spring bands or additional rigidifying edge elements in order to achieve such additional firmness.

The invention of this application which achieves these objectives comprises a spring interior having a plurality of longitudinally extending bands of interlocked or interlaced coil springs wherein the bands are disposed side by side so that their top faces lie in a top main face of the spring interior and their bottom faces lie in a bottom main face of the spring interior. The bands of springs are interconnected by helical wires lying in the top and bottom faces of the bands and extending across the bands with each helical wire embracing portions of wires of the bands that extend transversely of the bands. In order to increase the edge firmness of the ends of the spring interior, the endmost coils of each band of springs are interlaced throughout their length with the next adjacent coils of the band s that the endmost coil at each end of the band is generally coaxially aligned with the next adjacent coil of the band. This results in a doubling of the coils at the lengthwise ends of the spring interior and a resulting edge firmness of the ends of the spring interior.

In addition to the increased edge firmness which results from this construction of the spring interior, this interior also has the advantage of being more easily upholstered than prior art interlocked spring assemblies. This ease of upholstering is derived from the improved alignment of the border wires which surround the interior and which are attached to the endmost coils of the interior in the top and bottom faces of the interior.

These and other objects and advantages of this invention will become more readily apparent from the following description of the drawings in which.

Figure 1:
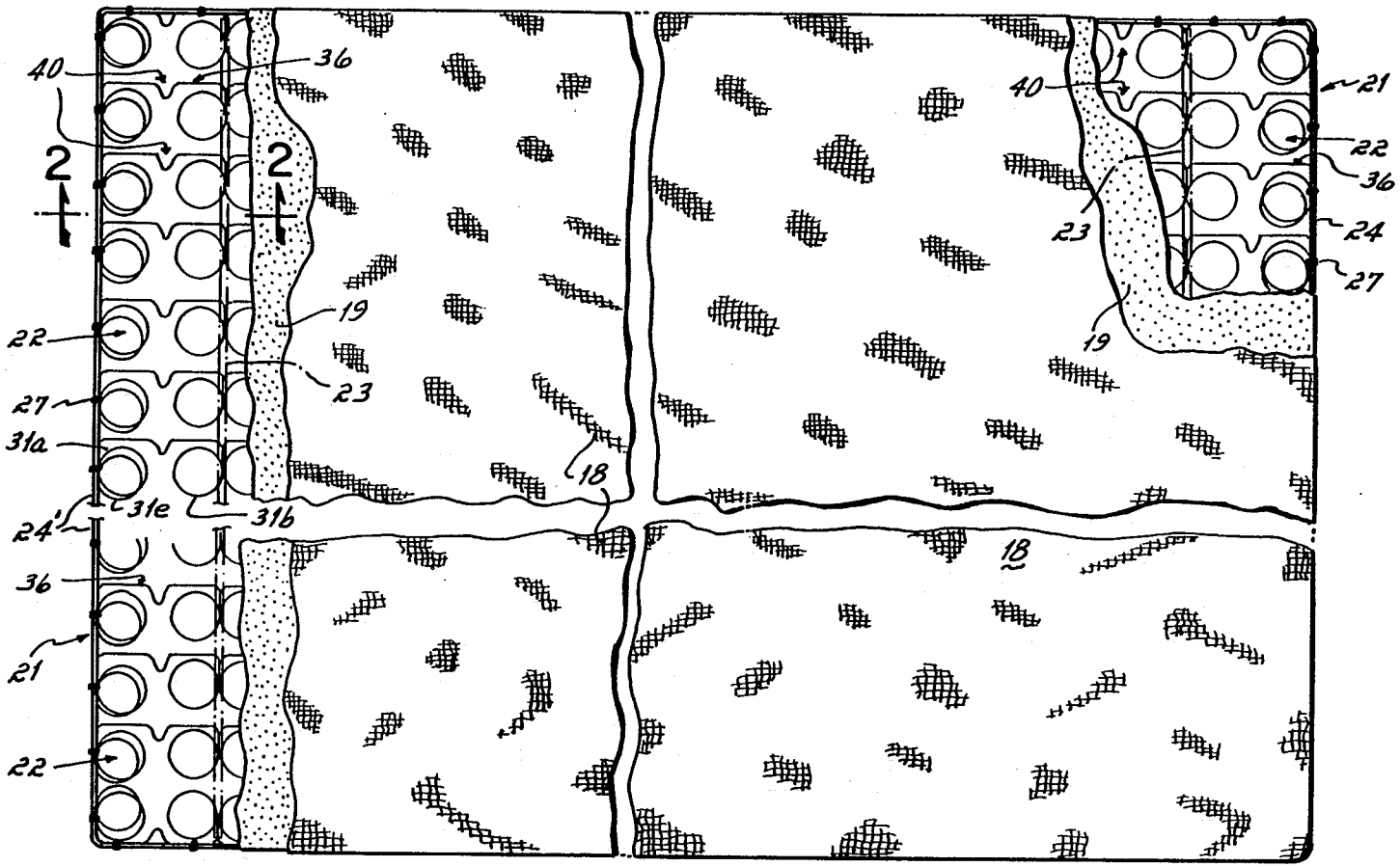
FIG. 1 is a top plan view, partially broken away, of a mattress incorporating the invention of this application.
Figure 3:
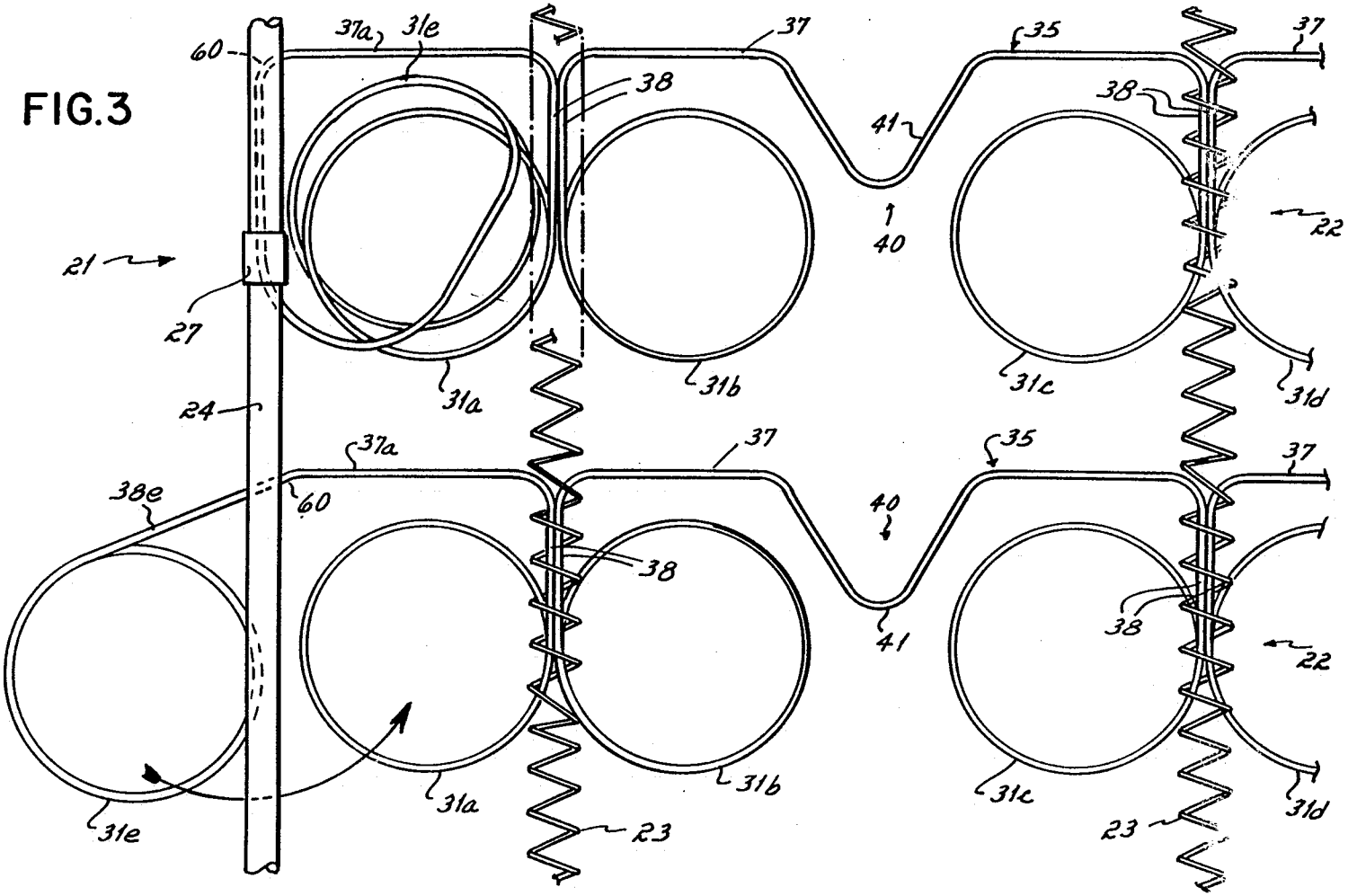

FIG. 3 a top plan view of a portion of the spring interior of FIG. 1 illustrating how the endmost coils of a row or band of coils is folded over and interleaved with the adjacent coil in the row of coils to form two endmost interleaved and coaxially aligned coils at the ends of the bands of coil springs.

With reference first to FIG. 1, there is illustrated a mattress 20 embodying the invention of this application. This mattress comprises a spring interior 21 on the top and bottom surfaces of which there is a pad 19. An upholstered covering 18 encases the spring interior 21 and the pads 19.

The spring interior 21 is formed from a plurality of bands of springs 22 which extend longitudinally of the mattress. These bands of springs 22 are laced together by helical lacing wires 23 which extend transversely of the spring interior and secure the bands of springs in an assembled relation. A pair of border wires 24, 24' extend completely around the periphery of the spring interior in the top and bottom planes 25, 26, respectively, of the interior and are secured to the outermost edge of the spring interior in these planes by conventional sheet metal clips 27.

Figure 2:
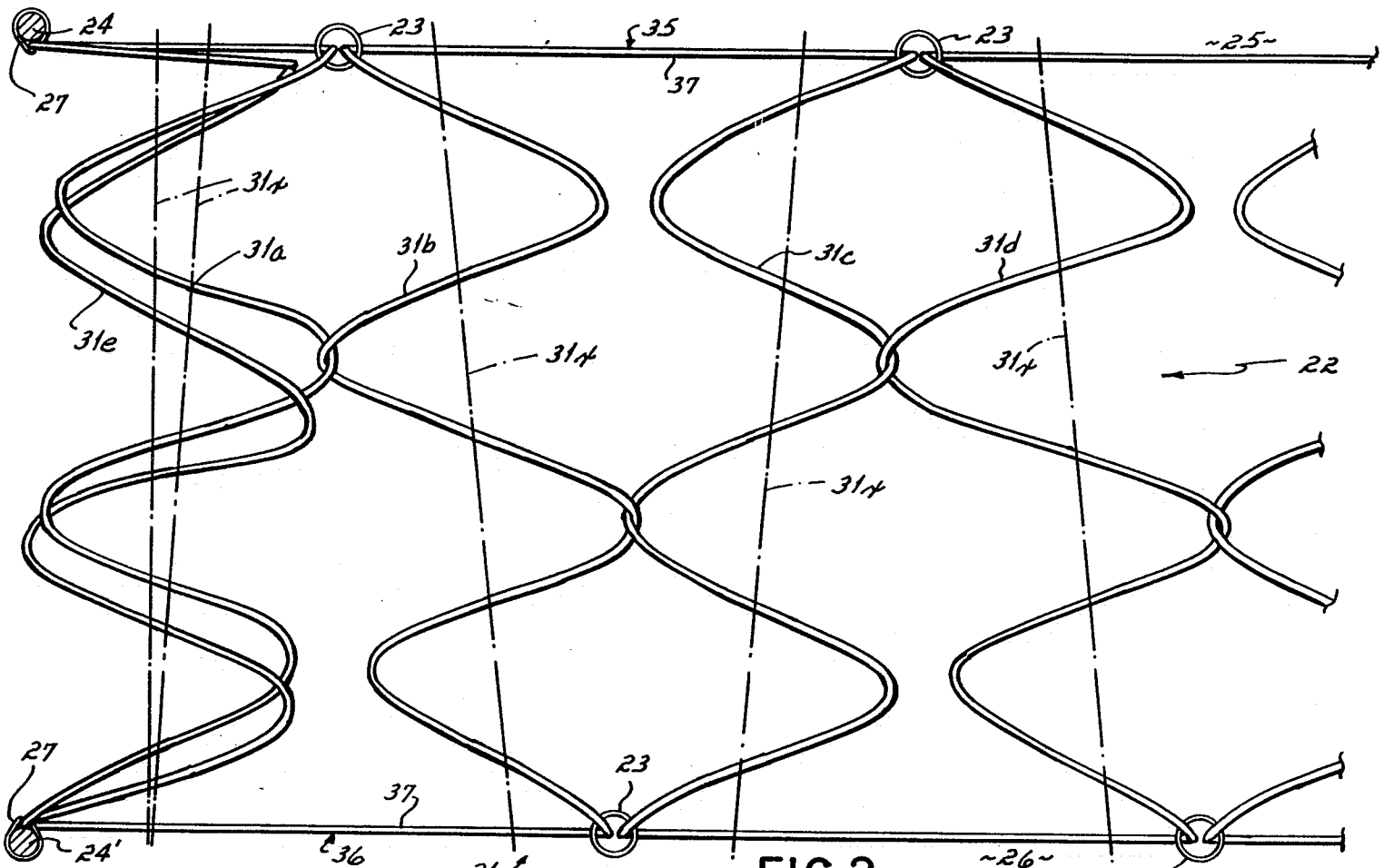
FIG. 2 is a cross-sectional view taken on line 2—2 of FIG. 1.

Each band of springs 22, a portion of one of which is illustrated in FIG. 2, is made from a single length of spring wire shaped to form a plurality of individual coil springs 31 arranged in a row. Each coil spring 31 comprises about two and one-half turns of wire. The axis 31*x* of each coil spring is slightly offset from vertical when viewed in the lengthwise direction of the band of springs, and is inclined slightly from vertical when viewed from the side lengthwise of the band, each spring when viewed from the side of the band being inclined in a direction opposite to that in which its two adjacent springs in the row are inclined. This slight inclination of the coils is clearly illustrated in FIG. 2. The end turns or convolutions of the coil springs 31 lie adjacent to the top and bottom faces 25, 26 of the band. Each coil spring, such as that numbered 31*b* (FIG. 2), is so coiled as to have a hand opposite to the hand of the adjacent coil springs, such as 31*a* and 31*c*, immediately before and after it in the row. Each coil spring is joined to the next adjacent coil spring by two interconnecting segments 35, 36 (FIG. 2) of the wire integral with the coil springs. One of the two interconnecting segments 35, 36 is in the top face 25 of the band 22, and the other is in the bottom face 26 thereof. For example, coil spring 31*a* (FIG. 2) is connected to coil spring 31*b* by interconnecting segment 36, which is in the bottom face of the band, and the coil spring 31*b* is connected to coil spring 31*c* by interconnecting segment 35, which is in the top face of the band. Each interconnecting segment 35, 36 comprises a bridging portion 37 (FIG. 3), which extends longitudinally of the row of coil springs and a pair of end portions 38 which extend in a direction normal to the longitudinal axis of the band 22. Those end portions 38 of the interconnecting segments 35, 36 also lie in the top and bottom faces 25, 26 of the band 22.

In the bands 22 illustrated in FIGS. 1–3, the location of the intersection between each end 38 of each coil spring 31*a*, 31*b*, 31*c* or 31*d* and the associated end portion of the interconnecting segments 35, 36 is well defined, for the coil springs are curved and the end portions 38 of the interconnecting segments are straight. In other constructions, however, the intersections may be less well defined because the end portions 38 of the interconnecting segments 35, 36 may be replaced by arcuate extensions of the coil springs 31*a*, 31*b*, 31*c*; in those last cases the interconnecting segments may be considered as consisting solely of the bridging portions 37.

Each bridging portion 37, in addition to extending longitudinally of the band, also extends laterally thereof to form a supporting structure 40. In the embodiment of FIGS. 1–3, the supporting structure 40 is in the form of a V-shaped indentation 41 of wire lying in the top 25 or bottom face 26 of the band 22, as the case may be, and extending to one side of the remainder of the bridging portion 37 of which it forms a part. Each V-shaped indentation 41 lies halfway between the end portions 38 of the interconnecting segment of which it forms a part, and it extends from one side face of the band toward the other side face thereof.

The method of manufacturing and the apparatus for manufacturing the band of springs illustrated in FIGS. 1–3 is completely described and illustrated in British Pat. No. 2,143,731. After the rows of coil springs are formed, each coil spring is interlaced with the next by having an intermediate turn thereof passed around an intermediate turn of the next spring. This coupling or interlacing can be carried out mechanically or manually.

A plurality of bands of springs 22 are assembled to form a spring interior 21. Bands of springs 22, each similar to that shown in FIGS. 1–3, are disposed side by side, and preformed helical wires 23 are attached to them. The helical wires 23 lie in the top and bottom faces 25, 26 of the bands and extend at right angles to the longitudinal axes of the bands. Each helical wire 23 embraces one pair of closely adjacent end portions 38 of each band.

It will be seen from FIG. 1 that much of the top and bottom faces of the spring interior have the general appearance of a rectangular grid. Each of the transverse elements of the grid comprises a helical wire 23, with the end portions 38 embraced by it, and each of the longitudinal elements of the grid comprises a row of mutually aligned bridging portions 37. Within the confines of each rectangle of the grid and disposed a little lower than the grid are the upper end portions of two adjacent coil springs 31. Were it not for the presence of the supporting structure 40, the top face 25 and bottom face 26 of the spring interior 21 would present relatively large rectangular apertures into which upholstery material, such as filling or padding 19, placed on top of the top face could readily enter, thereby giving rise to "cupping." The presence of the supporting structures 40, however, reduces any tendency to "cupping," as the supporting structures occupy central parts of the rectangular apertures and can serve to support the upholstery material.

In accordance with the practice of the invention of this application, the endmost coils **31*e* of each band of coils 22 are completely interleaved for full height of the coils with the next to last coils of the row. This results in the last two coils at each end of each row or band of coils 22** having axes which are generally coaxially aligned so that each band terminates in a "double coil," i.e., a pair of coils which are interleaved throughout their full height and have their axes generally coaxially aligned.

In order to create this "double coil" at each end of each row or band 22 of coil springs, the bridging portion **37*a* between each endmost coil 31*e* and the next adjacent coil is straightened and connected to the endmost end portion 38*e* via a 90° bend 60. The length of the bridging portion 37*a* is selected such that the endmost coil 31*e* is interleaved or interwoven with the next adjacent coil 31*a* for the full height of the coil as is best illustrated in FIG. 2. The endmost bridging portion 38*e* is then secured to the border wire by a metal clip 27**.

After assembly of the multiple rows of spring bands 22 and interconnection of those bands by means of the helical lacing wires 23, the rectangular border wires 24, 24' are secured to the edgemost coils of the spring assembly by the metal clips 27. Thereafter, the padding 19 is overlaid over the top and bottom faces of the assembled spring interior, and the complete unit, including the spring interior and padding, is enclosed within an upholstered covering 18.

Prior to the invention of this application and its utilization of double interlaced coils at the end of each band 22 of coil springs 31, there was a tendency for the border wires to be misaligned vertically. Otherwise expressed, the upper border wire oftentimes did not overlie the lower border wire, in part, because of the slight inclination of the coils in the lengthwise direction of the band as illustrated in FIG. 2. The border wires were often skewed, and as a result, it was difficult to apply an upholstered covering to the unit so as to obtain an aesthetically pleasing product. The invention of this application, because it utilizes two interlaced coils at the end of each band configures the interconnecting segment **37*a* between the last coil and the next adjacent coil such that the border wires 24, 24'** in the top and bottom faces of the spring interior vertically overlie one another. The result is a product which is much more easily upholstered and which results in an aesthetically more pleasing product than prior art interlaced spring interiors.

Another advantage which accrues from the double coils at the ends of each spring band is the increased edge firmness at the ends of the spring interior. This increased firmness is particularly useful in preventing edge breakdown when people sit on the end of the bed and over the endwise edge of the spring interior.

While I have described only a single embodiment of my invention, persons skilled in the art to which it applies will appreciate changes and modifications which may be made without departing from the spirit of my invention. Therefore, I do not intend to be limited except by the scope of the following appended claims.

I claim:

1. A spring interior comprising a plurality of bands of springs extending longitudinally of the spring interior, each band of springs comprising a single length of spring wire shaped to form a plurality of individual coil springs arranged in a row, one end turn of each coil spring lying adjacent to a top face of the band and the other end turn of each coil spring lying adjacent to a bottom face of the band, each coil spring being joined to adjacent coil springs by interconnecting segments integral with the coil springs, one of said interconnecting segments being located substantially in the top face of the band and the other of said interconnecting segments being located substantially in the bottom face of the band, and each interconnecting segment comprising a bridging portion which extends lengthwise of the row and a pair of endmost portions which extend transversely from opposite ends of the bridging portion, said bridging portion further including a supporting section located medially of the bridging portion, said supporting section extending transversely from the bridging portion, the bands being disposed side by side so that their top faces lie in top main face of the spring interior and their bottom faces lie in a bottom main face of the spring interior, the bands being interconnected by helical wires lying in the top and bottom faces of the bands and extending transversely across the bands, and the spring interior being characterized by at least one endmost bridging portion of each band having the supporting section thereof straightened and bent at approximately a 90° bend so as to position the endmost coil of at least one end of each band of springs in an interlaced condition throughout its length and generally coaxially aligned with the next adjacent coil of the band.

2. The spring interior of claim 1 wherein each coil spring of a band of springs is of a hand opposite to the hand of the adjacent coil springs of the band immediately before and after it in the row and is interlaced with the adjacent coil springs of the same row.

3. The spring interior of claim 2 which further comprises a pair of rectangular border wires surrounding said spring interior, one of said border wires being located in the top face of the bands and the other border wire being located in the bottom face of said bands, and said border wires being characterized by one border wire being located immediately above the other for ease of upholstering said spring interior.

* * * * *